US006523313B2

(12) United States Patent
Lin et al.

(10) Patent No.: US 6,523,313 B2
(45) Date of Patent: Feb. 25, 2003

(54) MAIN BEAM CONNECTION

(75) Inventors: Yu Lin, Blue Bell, PA (US); William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 09/800,416

(22) Filed: Mar. 6, 2001

(65) Prior Publication Data

US 2002/0124496 A1 Sep. 12, 2002

(51) Int. Cl.[7] ..... E04B 2/00; E04B 5/00; E04B 9/00

(52) U.S. Cl. ..... 52/506.06; 52/506.02; 52/506.08

(58) Field of Search ..... 52/506.07, 664, 52/506.06, 506.08, 665, 666, 667, 668

(56) References Cited

U.S. PATENT DOCUMENTS

| | | | | |
|---|---|---|---|---|
| 3,169,614 A | | 2/1965 | McCoy | |
| 3,221,466 A | | 12/1965 | Downing, Jr. et al. | |
| 3,979,874 A | * | 9/1976 | Cubbler et al. | 52/506.07 |
| 4,161,856 A | | 7/1979 | Brown et al. | |
| 4,314,432 A | * | 2/1982 | Rosenbaum | 52/484 |
| 4,317,318 A | | 3/1982 | Sauer | |
| 4,317,641 A | | 3/1982 | Sauer | |
| 4,448,006 A | * | 5/1984 | Worley | 52/506.07 |
| 4,499,697 A | | 2/1985 | La Londe | |
| 4,525,973 A | | 7/1985 | Vukmanic et al. | |
| 4,535,580 A | | 8/1985 | Shirey | |
| 4,611,453 A | | 9/1986 | Worley | |
| 4,648,230 A | | 3/1987 | Mieyal et al. | |
| 4,785,603 A | | 11/1988 | Platt | |
| 4,926,606 A | * | 5/1990 | Hanson | 52/463 |
| 4,989,387 A | | 2/1991 | Vukmanic et al. | |
| 5,044,138 A | * | 9/1991 | Zaccardelli et al. | 52/506.07 |
| 5,088,261 A | * | 2/1992 | Mieyal et al. | 52/506.07 |
| 5,271,202 A | | 12/1993 | Vukmanic et al. | |
| 5,517,796 A | | 5/1996 | Koski et al. | |
| 5,687,525 A | | 11/1997 | Koski et al. | |
| 5,839,246 A | | 11/1998 | Ziegler et al. | |
| 5,966,887 A | * | 10/1999 | Mieyal | 52/506.07 |
| 6,018,923 A | * | 2/2000 | Wendt | 52/506.07 |
| 6,041,564 A | * | 3/2000 | Shirey | 29/21.1 |
| 6,199,343 B1 | * | 3/2001 | Sauer et al. | 403/347 |
| 6,305,139 B1 | * | 10/2001 | Sauer | 403/346 |
| 6,341,466 B1 | * | 1/2002 | Kehoe et al. | 24/292 |

FOREIGN PATENT DOCUMENTS

| | | | | |
|---|---|---|---|---|
| EP | 0037517 | * | 3/1981 | E04B/5/58 |

* cited by examiner

*Primary Examiner*—Jose V. Chen
*Assistant Examiner*—Chi Q Nguyen
(74) *Attorney, Agent, or Firm*—Eugene Chovanes

(57) ABSTRACT

An end-to-end connection for main beams in a ceiling grid for a suspended ceiling. A connector is formed at the end of a beam by combining a clip, fastened to the beam, with a configuration in the end of the beam. The connections are engaged to form a connection. The connection can be disengaged and reengaged.

12 Claims, 5 Drawing Sheets

MAIN BEAM CONNECTION

BACKGROUND OF THE INVENTION

1. Field of the Invention

This invention relates generally to metal beams used in a grid structure for a suspended ceiling, and more particularly, to a connection that joins together, end-to-end, main beams in the grid.

2. Background Art

Suspended ceilings having metal beams called tees, or runners, that form grids to support panels, are well known. Such grids have main beams and intersecting cross beams. The beams are formed generally of flat sheet metal folded into an inverted T-shape, but in some instances are extruded metal, such as aluminum. The main beams are connected end-to-end and are suspended from a structural ceiling by wires. The cross beams are connected end-to-end through slots in the main beams and are supported by such main beams.

The main beams, which run parallel to one another, are generally spaced 48" apart. Cross beams are connected to the main beams to form either 24"×24" square openings, or 24"×48" rectangular openings, which receive the laid-in panels.

Such main beams in a suspended ceiling are subjected primarily to tension, compression, and bending stresses, and occasionally to twisting forces. The function of the connection, which joins the generally 12 foot lengths of main beams together longitudinally, is to resist these stresses and forces, and to maintain adequate strength and alignment between the beams.

Any compression forces on.the connection exist longitudinally of the beams, which abut each other end-to-end, so that the connection has only to keep the ends of the beams aligned to resist these compressive forces. Fire relief notches are cut into the beam proper to provide for expansion relief from these compressive forces in case of fire, since there is no give at the beam end.

As to tension forces that pull apart one beam from another longitudinally, the connection is the sole means to resist such tension forces. With respect to bending, the connection, along with the beam-ends, must provide resistance to such bending. The connection must also resist the occasional twist.

Prior art connections on the ends of main beams were generally of two types.

In one type of connection, the connector elements were formed integrally with the beam itself; particularly out of the web portion of the beam. Such a construction caused loss of material from the cutting away to achieve the connecting elements. Furthermore, the process to make such connectors was a relatively slow one since, although the beam itself was made relatively rapidly in a roll forming operation, the connector itself was formed in one or more braking operations that generally required intricate forming of the relatively soft grid tee metal. Additionally, the soft metal of the tee had relatively little spring qualities that could be used to form the connection.

In another form of main beam, or tee, connection, clips alone are used to form the connection. A separate clip is attached to the end of each tee, which is squarely cut at the end. A clip is inset into a pan depressed in the tee, so that the clips can engage solely with one another, independent of the tee, along the central plane of the web. Clips permit the use of harder, springier steel than web metal where the connection is formed from the tee.

SUMMARY OF THE PRESENT INVENTION

The connection of the present invention combines a pair of clips, as well as a pair of configured grid tees, to form a connection. Each of the clips fastened on a beam end is identical to the other clip in the pair, as is the grid tee construction at each of the beam ends identical to the construction on the other beam end in the pair.

A clip has holes for attachment to a beam web and has spring tabs that act to ramp the end of an opposing clip over a web during engagement, and then contract under pressure from the engaged connectors.

The beam itself has an end configuration essentially square but with a web cutout that eliminates interference with any stitches in the web and that also guides a clip while being engaged to form a connection. A spring pocket formed in the web of the beam, and an opening formed by the spring pocket, along with positioning bosses formed in the web, cooperate to permit a clip and beam end on one beam to engage and lock with a clip and end on an adjacent beam.

The clips themselves have elements, which cooperate with the integral beam elements, and the opposing clips, to form the connection.

The connection can be disengaged by, for instance, deforming the pockets to an open position and then separating beams sideways. The connection can be reengaged for reuse by simply restoring the pockets to their original closed position, and bringing the connectors together. When connected, the clips straddle the abutting webs with a clip on each side of the aligned webs.

In summary, the present invention combines a clip on a configured beam end, with the configured beam end itself, to form a main beam end-to-end connection with another combination of clip and configured beam end.

DESCRIPTION OF THE PREFERRED EMBODIMENT

Two clips 20 and 20', each identical to the other, are used to form, with grid tees 70 and 70', a beam connection 96 of the invention. Clip 20 and tee 70 will be described with identification numbers. Clip 20' and grid tee 70' will carry the same identification numbers with a prime (') notation.

Figure 1:
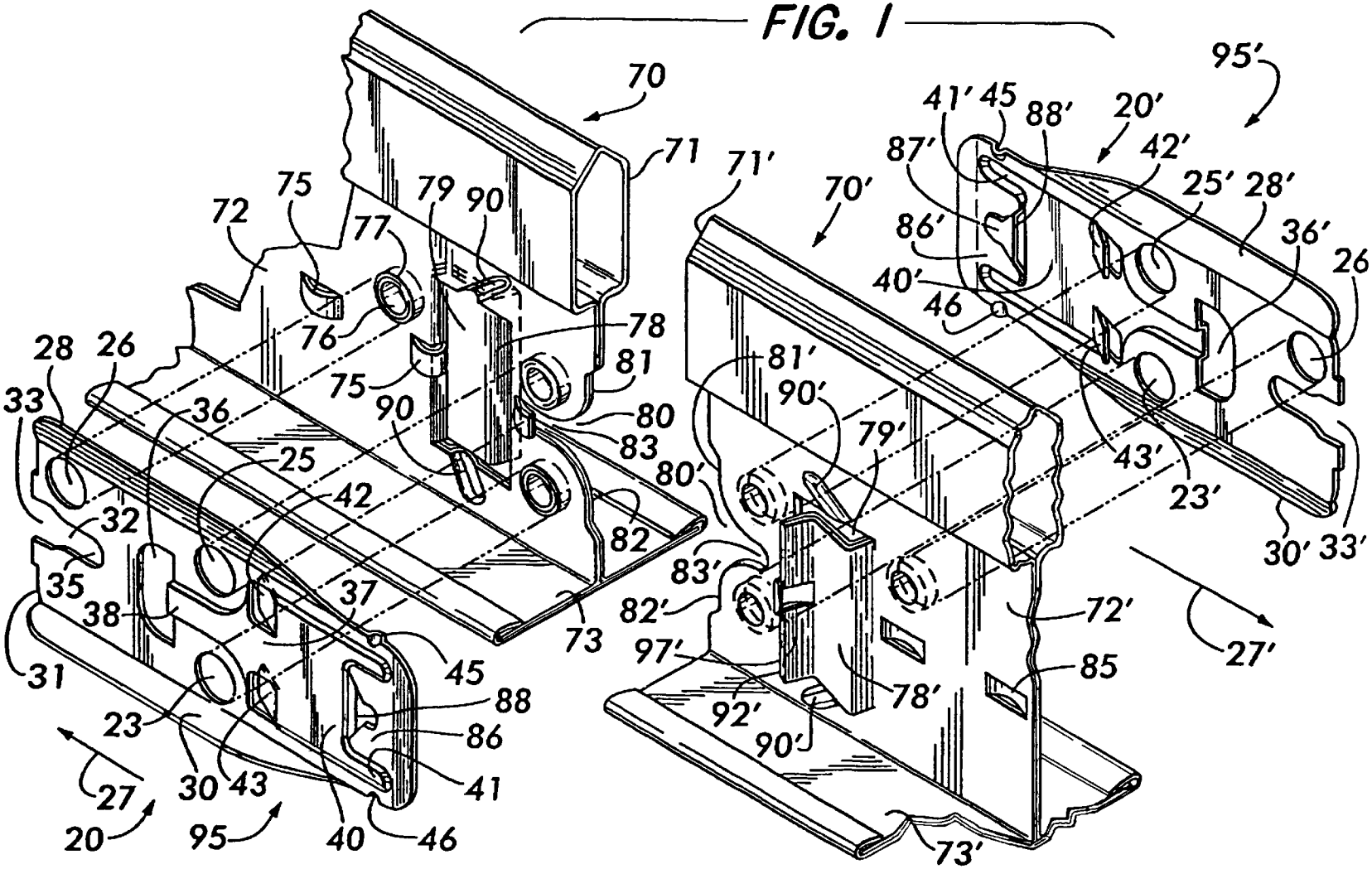
FIG. 1 is an exploded perspective view of the clips, and the configured beam ends, that combine to form the connection of the invention.

Each clip 20 is roughly rectangular and is formed, preferably by stamping, from relatively hard steel, having spring properties. The clip can suitably have a thickness of 0.0150", with a generally rectangular dimension of 1" by 1¾". As seen in FIG. 1, punched holes 23 and 25 are above one another and are formed in the approximate center of the clip 20. A third hole 26 forming a triangle with the first two is formed at the rear of the clip. Arrow 27 points to the rear of the clip.

Flanges 28 and 30 are formed at the top and bottom edges of the clip 20, to stiffen the clip. The flange 28 and 30 are angled outwardly from the clip away from the tee web 72.

Figure 2:
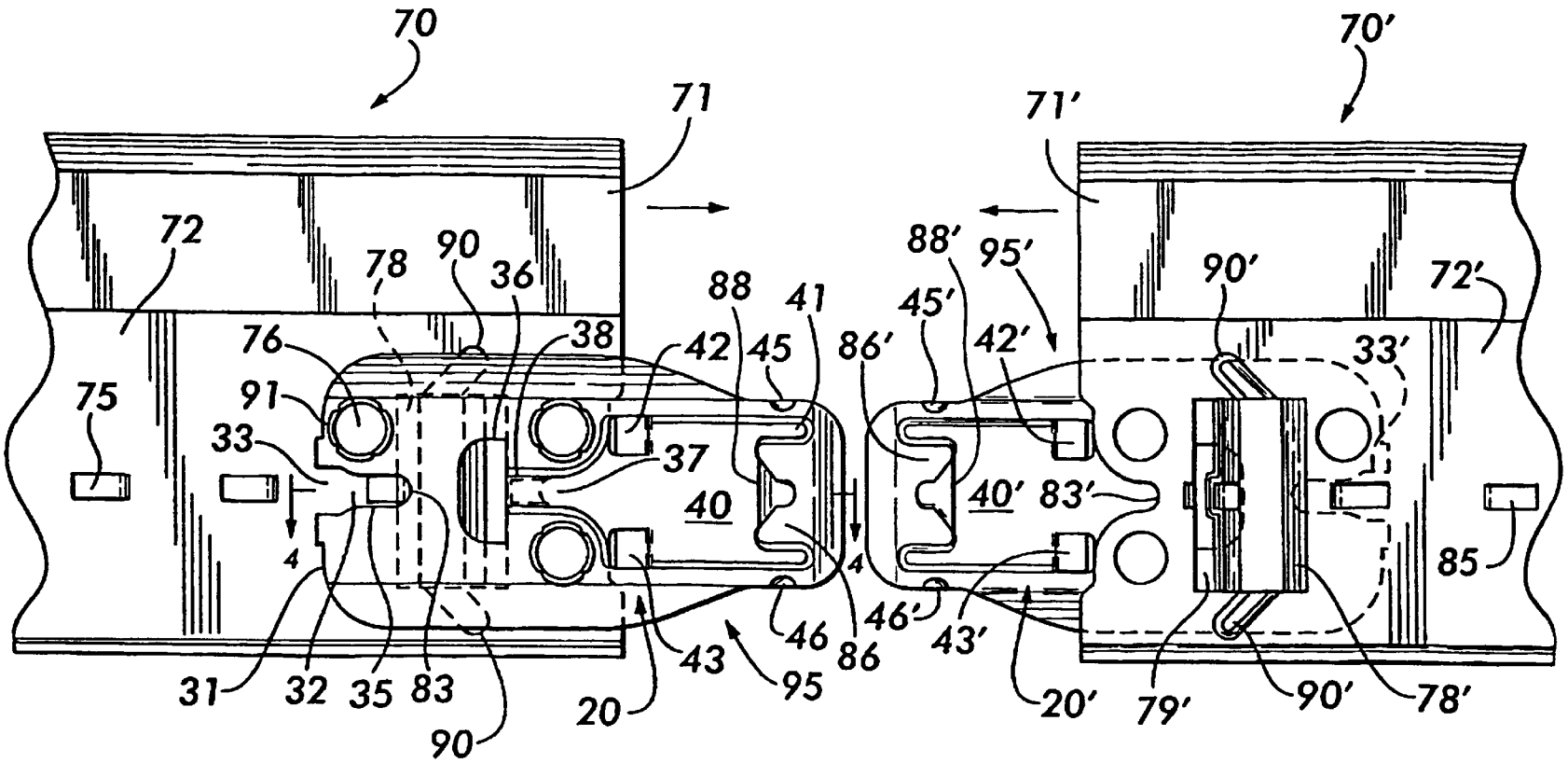
FIG. 2 is a side elevation view of a connector clip attached to each of the aligned beam ends, just prior to being engaged in an end-to-end connection.

Clip 20 has, in its rearward edge 31, a cutout 32 having an expanded section 33 and a reduced section 35. Forward of cutout 32 in clip 20, is cutout 36 in the form of a reversed D as seen in FIGS. 1 and 2. Forward of cutout 36 in clip 20 is an elevated contoured pan 37.

The pan 37 has a tapered rearward section 38, which abuts cutout 36 and a forward section 40 having a forwardly extending U-shaped portion 41.

Spring, pierced, tabs 42 and 43 extend rearwardly of the clip and extend toward the web 72 grid tee when assembled to the tee.

Offsets 45 and 46, at the top and bottom of the forward portion of clip 20, extend toward the grid tee in the assembled condition.

The clips 20 and 20' are intended to be secured to webs 72 and 72' at the ends of a grid tee 70 and 70', respectively. As seen in FIG. 1, grid tee 70 includes a bulb 71, a web 72, and a flange 73. Stitches 75 extend along the web 72.

The connection of the invention particularly lends itself to the grid tee disclosed in U.S. Pat. No. 6,138,416, incorporated herein by reference. The grid tee disclosed in the '416 patent permits the use of lighter gauge metal while still achieving the necessary beam strength, particularly in bending. The present invention compensates for the lighter gauge metal in the beam, at the connection, so that even with such lighter gauge metal in the beam, a strong and secure connection is obtained.

Holes 76 in the web 72 conform to the hole spacing in clip 20, and are formed by piercing the web so that a collar 77 extends out of the web, as seen in FIG. 1.

Figure 4:
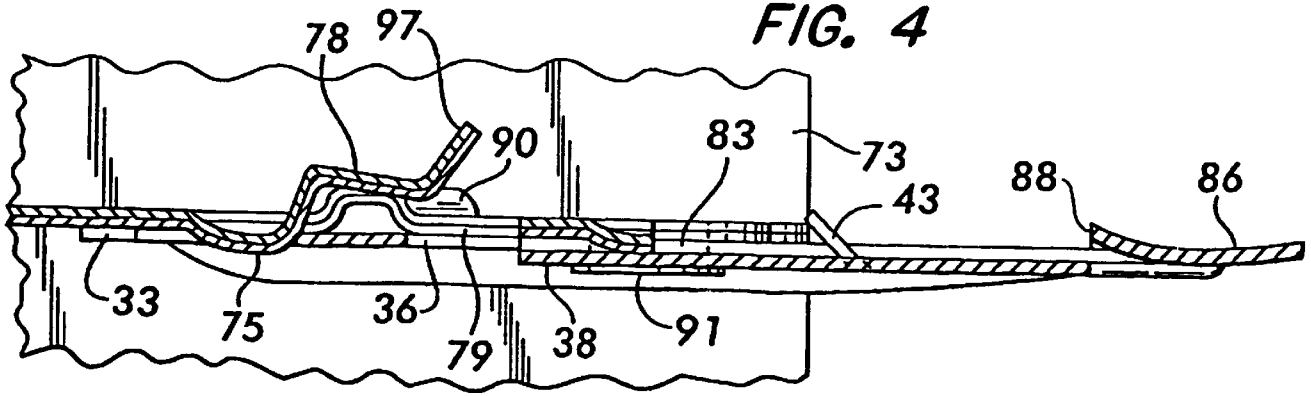
FIG. 4 is a sectional plan view of a clip attached to the end of a beam.
Figure 5:
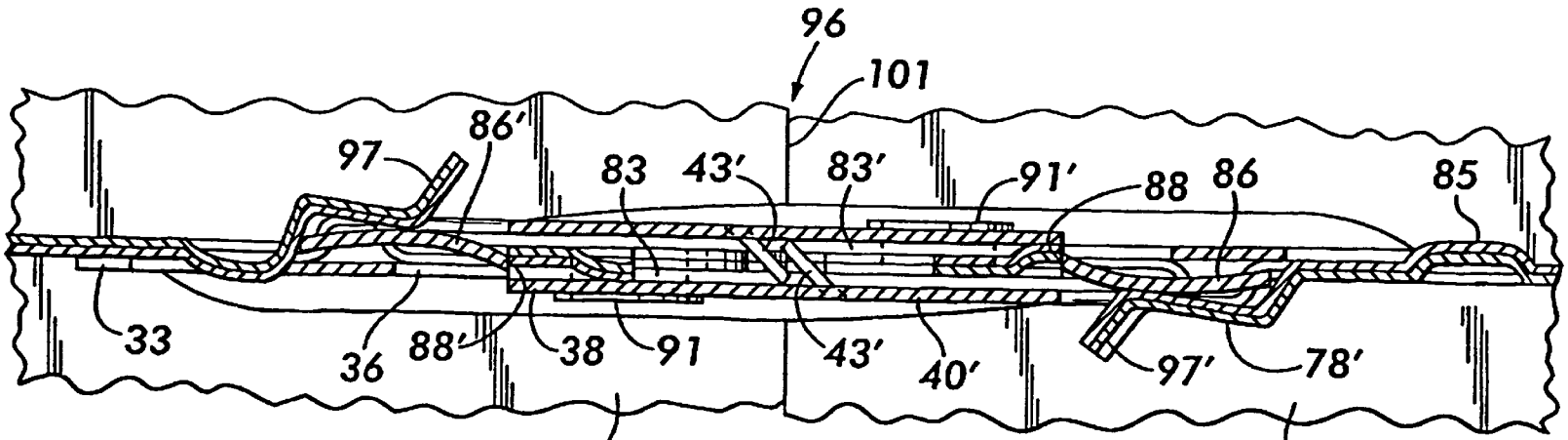
FIG. 5 is a sectional plan view, similar to FIG. 4, showing the clips and beam ends engaged to form the main beam connection of the invention.

The web 72 has a relatively large pocket 78 formed from the web 72. The pocket 78 is in the form of a Z in cross-section and is open in a forward direction in the web. An offset forward portion 92 of the pocket 78, as best seen on pocket 78' at 92' in FIG. 1, serves to stiffen the pocket and to guide the forward end of a clip during engagement of the connection. The pocket 78 extends away from web 72 on the side of the web opposite to the side on which clip 20' will be attached as best seen in FIG. 4. An opening 79 is created in web 72 when pocket 78 is formed from the web 72, as seen best in FIGS. 1 and 4 as by stamping.

Web 72 at its end has a cutout 80 having forward edges 81 and 82, and a rearward tapered opening 83, as seen in FIG. 1.

Stitches 85, of a type shown, for instance, in U.S. Pat. No. 5,979,055, incorporated herein by reference, extend along the web to strengthen the beam, as shown, for instance, in FIG. 2. These stitches 85 are placed in the beam during a continuous roll forming process, before the beam is cut into, for instance, 12 foot lengths, by, for instance, flying shears. Such method of making a beam by roll forming and cutting into lengths is well known.

After cutting of the beam into lengths, the ends of the beam are stamped or otherwise formed into the configuration shown in the drawings and described herein.

Portions of stitches 85 may continue to exist in the end configuration of the beams, but such portions have no effect in the connection.

Pan 37 creates a rectangular portion 86 in the plane of the web 72 that has therein a pierced V-shaped abutment 87, that extends rearwardly of clip 20 and extends toward web 72 of a grid tee 70, to which clip 20 is attached. These features are best seen in FIG. 1 on identical connector 95' with identifying prime numbers.

Figure 3:
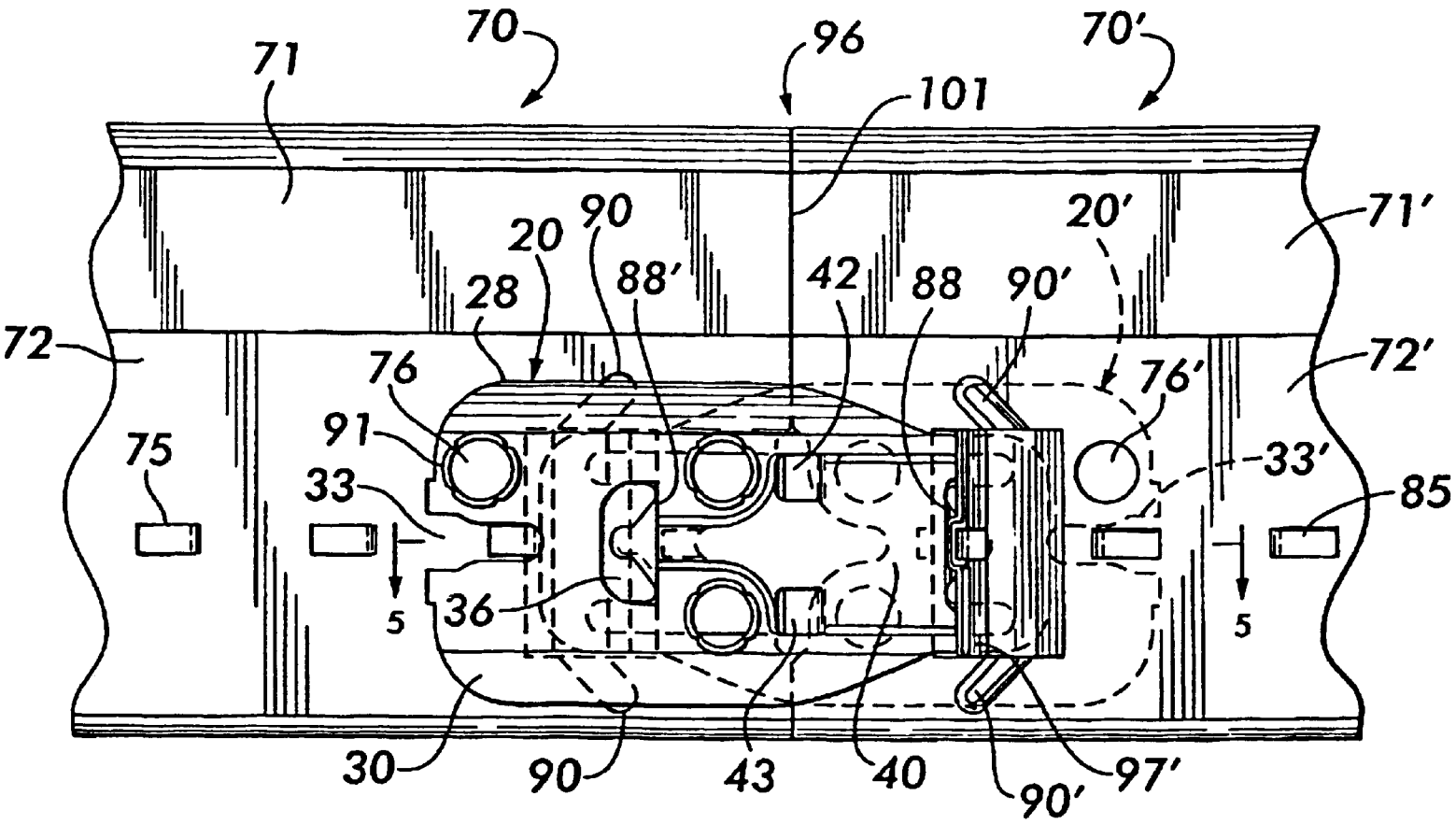
FIG. 3 is a side elevation of engaged clips and beam ends forming a main beam connection.

The clip 20 is attached to grid tee 70 by inserting holes 23, 25, and 26 over collars 77 of holes 76 in grid tee web 72 at the end thereof. The collars are staked over at 91 to hold the clip 20 securely to the beam 70, as seen in FIGS. 2 and 3. Pierced, spring tabs 42 and 43 will extend above the web at cutout 80 at 81 and 82,to provide a ramp effect that guides the forward end of opposing clip 21' over the edges 81 and 82, during the engagement of the connection. This avoids any interference of the opposing clip and web. Spring tabs 42 and 43 are free of contact with edges 81 and 82, so that the tabs are free to depress when the connectors are fully engaged. Thus tabs 42 and 43, in extended position act as ramps, and they can contract to permit engagement of the connectors.

D-cutout 36 in clip 20 will line up with opening 79 in the web 72 of grid tee 70, with the straight edge of the D in line with the forward edge of opening 79 in the web 72.

Rearward tapered opening 83 in clip 20 provide clearance for any stitch 85 that may extend into the area of the opening.

The clip 20 attached to configured end of beam 70 forms a connector 95, and clip 20' attached to configured end of beam 70' forms a connector 95'.

Connector 95 is engaged with connector 95' by moving the connectors together longitudinally of the aligned beams, as shown in FIGS. 2 and 3.

As seen in FIG. 2, the forward ends of clips 20 and 20' attached to opposite sides of the webs 72 and 72' are slid toward one another until the connectors 95 and 95' are fully engaged, and locked, into a connection 96, as seen in FIG. 3. When connection 96 is engaged, edge 88' of pierced V-shaped abutment 87' will extend through opening 79 and into D cutout 36, and engage the forward edge of opening 79 and cutout 36.

Edge 88' will be secured into such engagement by pocket 78 which receives rectangular portion 86' of clip 20' and clamps portion 86' against web 72. The same clamping action will occur wherein pocket 78' will keep edge 88 of pierced V-shaped abutment 87 against the forward edge of opening 79'.

In the connection 96, the square cut ends of grid tee 70 and grid tee 70' will abut, as seen particularly in FIG. 3 at 101. The clip 20,20' extend along each side of beam 70,70' ends to provide a fishplate splice in the connection 96. The clips 20,20' act as fishplates to lap the joint of the beams 70,70' and are secured to take sides so as to connect the beams 70,70' end-to-end.

During the engagement of the connection, the forward end of clip 20 is guided, and also restrained vertically, as seen particularly in FIG. 3, by bosses 90' in web 72'. Additionally, the forward end of clip 20 is restrained vertically by the engagement of offsets 45 and 46, which extend within opening 79' at the top and bottom thereof. The forward end of clip 20 is clamped against web 72' so that the forward end of clip 20 is kept laterally within bosses 90' and offsets 45 and 46 are kept laterally within opening 79'.

Pocket 78' has some spring effect to accomplish this clamping. The forward edge of the pocket is flared outward at 97' to guide opposing clip 20 into clamping engagement.

The identical clamping action occurs between pocket 78 and clip 20'.

The beams that will be restrained from separating longitudinally by the engagement of edge 88' with the forward edge of opening 79 and cutout 36, in one connector, and by the engagement of edge 88 with the forward edge of opening 79' and cutout 36'.

A further guiding action occurs during the engagement of connection 96. V-shaped abutment 87' enters rearward tapered opening 83 in cutout 80 of clip 20, and is guided into guiding engagement with diagonal bosses 90 into pocket 78. When edge 88' of V-shaped abutment 87' passes into opening 79 and D-cutout 36, pocket 78 springs edge 88' into engagement with the forward edge of D cutout 36 and forward edge of opening 79. A similar action occurs in pocket 78'.

When connection 96 is in this engaged condition, offsets 45 and 46 will engage opening 79' at the top and bottom thereof, and the forward portion of clip 20 will lie within bosses 90 and be restrained against vertical movement. A like engagement occurs between offsets 45' and 46', bosses 90', and the forward end of clip 20.

Figure 6:
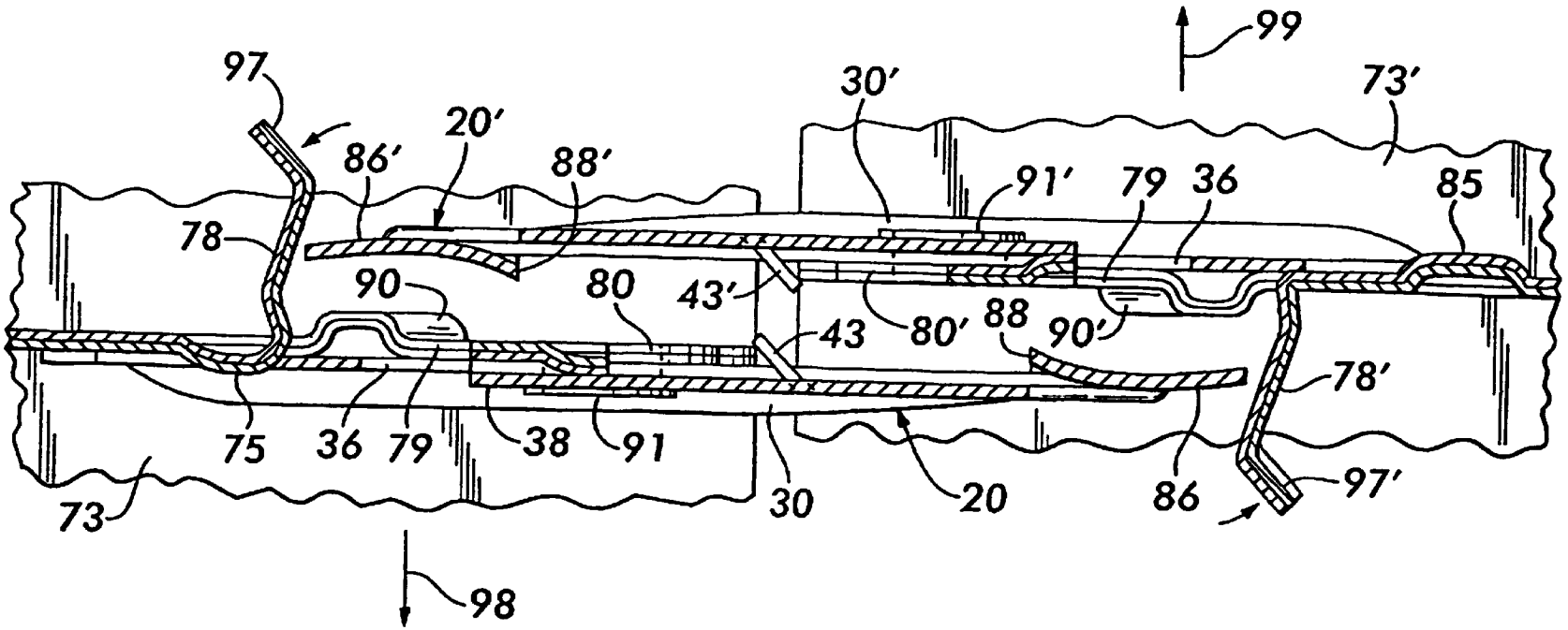
FIG. 6 is a sectional plan view, similar to FIG. 5, showing the connection being disengaged to permit the main beams to be separated.

The connection can be disengaged in a manner illustrated in FIG. 6. Pockets 78 and 78' are rotated in the direction shown by the arrows by inserting an edged tool, such as a screwdriver, and bending and deforming the pockets to the positions shown. Since the web metal from which the pockets are formed is a relatively soft metal, the pockets will stay in the deformed position. The connectors 95 and 95' are now free to be laterally separated from one another, as shown by arrows 98 and 99, causing the connectors 95 and 95' to become disengaged.

The connectors 95 and 95' can be reengaged, if desired, by reversing the disengagement steps set forth above, including bending pockets 78 and 78' back to their closed position.

What is claimed is:

1. A main beam connector (95) capable of being assembled in the field with an identical main beam connector (95') to form an end-to-end connection (96) of main beams (70,70') in a ceiling grid, the main beam connector (95) having a) a pocket (78) formed about an opening (79) in a web (72) of the main beam (70), the pocket (78) being formed from the web (72); and b) a clip (20) secured to an end of main beam (70) with, in an assembled end-to-end connection (96) of main beams (70,70'), 1) a forward end (86) of the clip (20) adapted to be clamped within a pocket (78') formed from the web (72') of the main beam (70') in the identical connector (95'), and 2) an edge (88) in the clip (20) adapted to engage an opening (79') in a web (72') of the main beam (70') in the identical connector (95'), when forward end (86) of clip (20) is clamped within the pocket (78') formed about the opening (79'), the pocket (78') being formed from the web (72').

2. The connector (95) of claim 1, wherein the edge (88) in the clip (20) is adapted to enter, on the identical connector (95'), a cutout (36') in the clip (20') that is aligned with opening (79'), in an assembled end-to-end connection (96) of main beams (70,70').

3. The connector (95) of claim 1, wherein the ends of main beams (70,70') abut in an assembled end-to-end connection (96) of main beams (70,70').

4. The connector (95) of claim 1, wherein bosses (90') in beam (70') end a) guide clip (20) while the connectors (95,95') are being assembled to form end-to-end connection (96), and b) position the clip (20) within the pocket (79') when connectors (95,95') are assembled into the end-to-end connection (96) of main beams (70,70').

5. The connector (95) of claim 1, wherein offsets (45,46) extend in an assembled end-to-end connection (96) of main beams (70,70'), within opening (79') of the identical connector (95') at the top and bottom thereof, to position the clip (20) within pocket (78).

6. The connector (95) of claim 1, wherein pocket (78) has an offset forward portion (97) that serves to stiffen pocket (78) and to guide the forward end (86') of clip (20') of the identical connector (95') during the assembly of the end-to-end connection (96) of main beams (70,70').

7. The connector (95) of claim 1, wherein the main beam (70) has stitches (75) in the web of the beam (70), and the clip (20) has a cutout (80) to provide clearance for the stitches (75).

8. The connector (95) of claim 1, wherein, in an end-to-end connection of main beams (70,70'), a cutout (80) has a rearward tapered opening (83) that guides a V-shaped abutment (87') on clip (20') into engagement with diagonal bosses (90) and into pocket (78) in connector (95).

9. The connector (95) of claim 1, wherein the clip (20) has pierced spring tabs (42,43), that extend rearwardly of the clip (20) and extend toward the main beam (70) end when clip (20) is secured to the main beam (70), wherein tabs (42,43) provide for a ramp effect that guide the forward end of opposing clip (20') over edges (81,82) of main beam (70) end during assembly of the end-to-end connection (96) of main beams (70,70') and are free to depress when the connectors (95,95') are fully assembled.

10. The connector (95) as in any one of claims 1 to 9, wherein the end-to-end connection (96) of main beams (70,70') is capable of being disassembled in the field by deforming pockets (78,78') to an open position, and moving the connectors (72,72') laterally apart.

11. The connector (95) of claim 1, wherein the ends of the main beams (70,70') are square cut and abut one another in the end-to-end connection (96) of main beams (70,70').

12. The connector (95) of claim 11, when assembled in the field with an identical main beam connector (95'), has a clip (20,20') extending along each side of the main beam (70,70') ends to provide a fishplate splice in the end-to-end connection (96) of main beams (70,70!).

* * * * *